United States Patent [19]

Benfield

[11] Patent Number: 4,799,295

[45] Date of Patent: Jan. 24, 1989

[54] DRAWBOX AIR SHUT-OFF AND METHOD FOR DOFFING A TEXTILE COMBER

[75] Inventor: Dan W. Benfield, Easley, S.C.

[73] Assignee: Platt Saco Lowell Corporation, Easley, S.C.

[21] Appl. No.: 72,328

[22] Filed: Jul. 13, 1987

[51] Int. Cl.[4] ..... B65H 54/80

[52] U.S. Cl. ..... 19/159 R; 19/107; 19/263

[58] Field of Search ..... 19/107, 159 R, 159 A, 19/263

[56] References Cited

U.S. PATENT DOCUMENTS

| | | | |
|---|---|---|---|
| 4,256,130 | 3/1981 | Smith | 19/107 X |
| 4,283,814 | 8/1981 | Ford et al. | 19/159 R |
| 4,709,452 | 12/1987 | Cooley et al. | 19/159 R |

*Primary Examiner*—Louis K. Rimrodt
*Attorney, Agent, or Firm*—Cort Flint

[57] ABSTRACT

A textile comber drawbox shut-off and method are disclosed for terminating the supply of suction air to the drawbox during doffing. Suction air shut-off assemblies B are placed in suction lines 56 leading to vacuum cleaning nozzles 50, 52 of the drawback which clean coiler units A during drawing off of combed sliver 48. Pivotal flapper valves C are tied together by air cylinder D for simultaneous operation. In accordance with the method, upon a prescribed amount of sliver being deposited in cans 26, the comber and supply of suction air are stopped. Following doffing of the full cans, the comber is restarted and the supply of suction air remains shut off by closed valves C. After approximately 60 seconds, of high operation speed, the closure valves C are simultaneously actuated to once again establish suction air in drawbox enclosure 28 for cleaning. Elimination of excessive suction in enclosure 28 during restart eliminates air interference in coiler tube 40 caused by air seepage in a direction opposite that to which sliver 48 travels through coiler tube 40.

11 Claims, 3 Drawing Sheets

DRAWBOX AIR SHUT-OFF AND METHOD FOR DOFFING A TEXTILE COMBER

BACKGROUND OF THE INVENTION

The invention relates to a textile comber for combing cotton. In the typical comber, a combed sliver is produced and coiled into a delivery can by a coiling unit in a drawbox. In the drawbox, the combed sliver is drafted, condensed, and fed by calender rolls into the delivery can by a rotating coiler tube. A vacuum cleaning system keeps the calender rolls, drafting rolls, and other elements so the coiling unit in the drawbox free of lint, dust, and other air borne matter. The same vacuum system is used to remove noil (shorter cotton fibers separated from the longer fibers by combing) from the combing units. During a doffing cycle, the comber stops and the full delivery cans are replaced with empty cans. Upon comber restart, sliver delivery through the coiling tube must be reliably resumed. Because suction air remains on during this cycle, drawing air through the coiling tube against sliver travel, resumption of sliver delivery is often prevented. A proper method or device has not been proposed for reducing this problem. One attempt has been to open the drawbox cover which encloses the coiling units. This breaks the suction in the drawbox. This leaves the moving coiling unit parts exposed during start-up. There is a natural tendency to reach into the coiling unit area to assist entry of the sliver into the coiler tube. If care is not exercised by the operator, personal injury may occur. Other malfunctioning of the coiling unit parts may also result. Windows in the cover and safety switches to prevent opening during operation have been provided. These have not been totally effective.

Accordingly, an object of the invention is to provide improved apparatus and method for operating a comber following a doffing cycle which eliminates the need and tendency to open the drawbox cover and expose the operator or machine parts to damage.

Another object of the invention is to provide apparatus and method for shutting off the suction air of the drawbox of the textile comber during start-up following the doffing cycle to ensure that the sliver is positively fed into the coiler tubes and fed into an empty delivery can.

Accordingly, an object of the invention is to provide an apparatus and method for shutting off suction air to the drawbox during a doffing cycle of a textile comber.

SUMMARY OF THE INVENTION

It has been found that the objectives may be accomplished by placing an arrangement of two shut-off ducts in the air suction supply lines to the drawbox. Each shut-off duct comprises a bearing mounted flapper valve and pivot arm. An air cylinder and adjusting link tie the duct assemblies together for simultaneous actuation of the flapper valves. A timing circuit is utilized to control an air supply to the air cylinder for actuation. In accordance with the method during the doffing cycle, the flapper valves are closed and suction air is shut off to the drawbox during doffing and for a period of time after start-up. This period of time allows the sliver to be delivered down the coiler tubes and into the delivery cans without air interference. At the end of this period, which corresponds to high speed operation, the air cylinder is actuated. The flapper valves are opened to allow the air suction to be restored to the drawbox for cleaning. Doffing with a minimum of stops and elimination of the need and tendency to open the cover of the drawbox are provided.

DESCRIPTION OF THE DRAWINGS

The construction designed to carry out the invention will hereinafter be described, together with other features thereof.

The invention will be more readily understood from a reading of the following specification and by reference to the accompanying draawings forming a part thereof, wherein an example of the invention is shown and wherein.

DESCRIPTION OF A PREERRED EMBODIMENT

Figure 1:
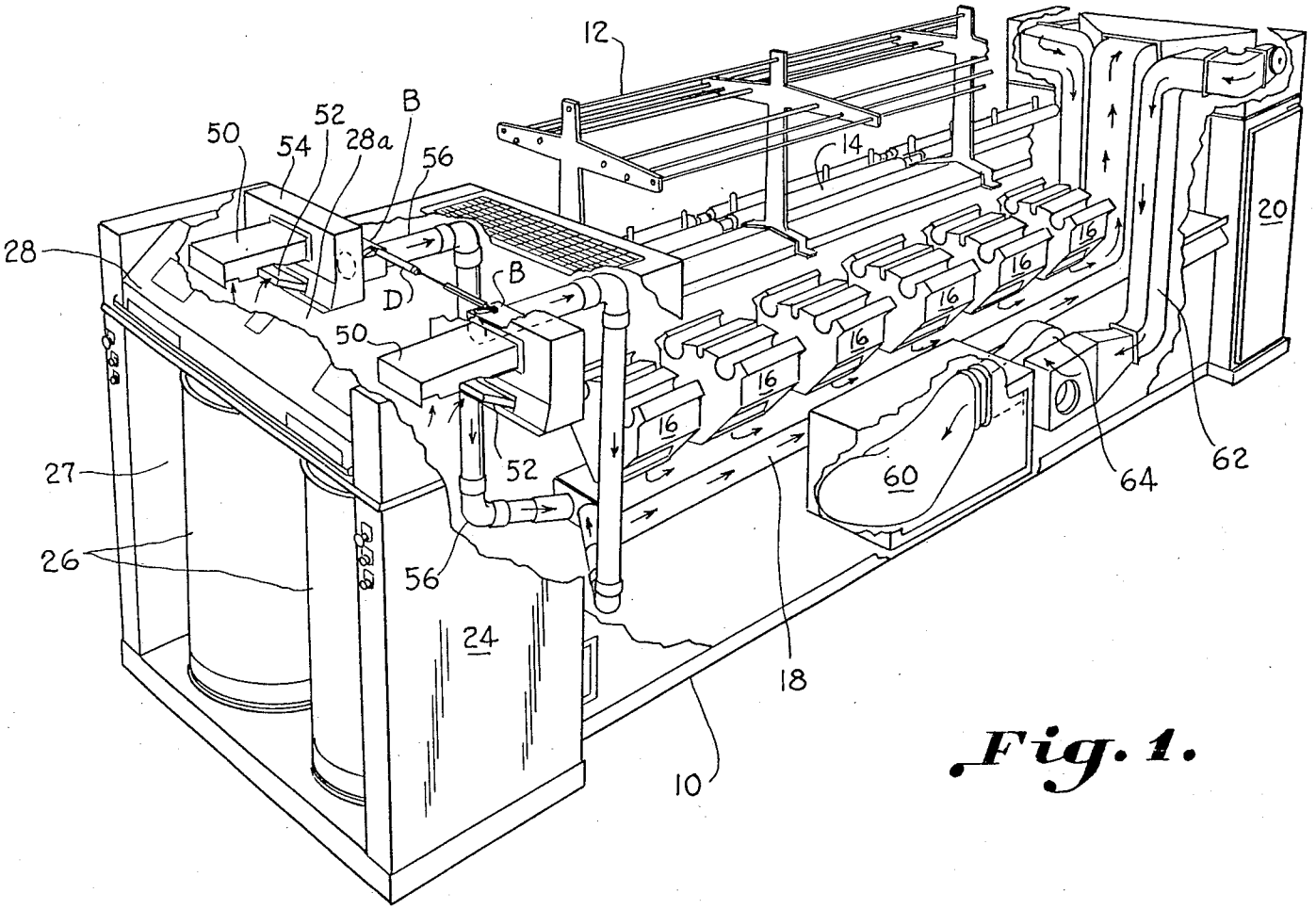
FIG. 1 is a perspective view of a textile comber and vacuum cleaning system incorporating a drawbox air shutoff and method of the present invention.

Referring now in more detail to the drawings, a textile comber is illustrated at 10. A conventional comber to which the present invention has particular application is a Model CA comber manufactured by the Platt Saco Lowell Corporation of Easley, S.C. Since the comber is conventional, only that detail necessary to an understanding of the present invention will be described. The conventional comber includes upper storage creel 12 in which thread packages are stored. A power drive creel 14 provides constant lap feed of cotton yarn from a yarn package (not shown) to each combing unit 16. There are six combing units 16 shown each of which contains two combing heads (not shown). Each combing unit 16 is connected to a central noil collection box 20 by way of a slot opening 22. During combing, the short fibers are combed out of the yarn. Longer fibers above a pre-determined length remain and are processed into sliver. The shorter fibers (noil) are processed into a noil mat. The noil is removed by vacuum to a central noil collector 20. The collected noil is formed into a continuous mat by a rotary screen condenser. The noil mat is carried away from the comber. At the opposing end of the comber is a drawbox 24. A pair of delivery cans 26 are rotatably carried in an open area 27 of drawbox 24. Above the delivery cans is a pair of coiler units designated generally as A, enclosed in drawbox enclosure **28*a* by a cover 28. As can best be seen in FIG. 3, each coiler unit A generally includes a drafting element 30, a calender 32, a sliver condensing trumpet 34, a coiler plate 36, and a rotating coiler 38. There is a coiler tube 40 carried by coiler 38. Drafting element 30 consists of four spring-weighted top rolls and four bottom rolls as shown. There is a clearer 42 above the top rolls. Calender 32 includes three fluted rolls 32*a*, 32*b*, and 32*c* as shown. Combed sliver 48 is drafted by drafting element 30, condensed by trumpet 34, and fed to calender 32. The calender rolls deliver the sliver into coiler tube 40. Coiler tube 40 and rotating coiler 38 coil sliver 48 into a delivery can 26. A vacuum cleaning system for the comber can best be seen in FIG. 1. There is an upper vacuum cleaning nozzle 50 and lower vacuum cleaning nozzle 52 for each coiler unit A. Nozzle 50 cleans the area of the calender 32, trumpet 34 and the top rolls of drafting element 30. Vacuum nozzle 52 primarily removes waste from the bottom rolls of drafting element 30 and the coiler plate area. Nozzles 50 and 52 are connected to vacuum boxes 54 which in turn are connected to a suction lines 56. Suction lines 56 are connected to central noil collector box 18. The waste from drawbox enclosure 28***a* is conveyed by suction air along with the noil and trash removed from the comber units 16. The noil is separated out by the condenser screen in collector 20. The remaining waste and trash are conveyed to a filter bag 60. A blower fan 64 delivers the trash and waste to filter bag 60 by way of suction duct 62 which is connected to the interior of the condensing screen. The previously described features are conventional.

Figure 2:
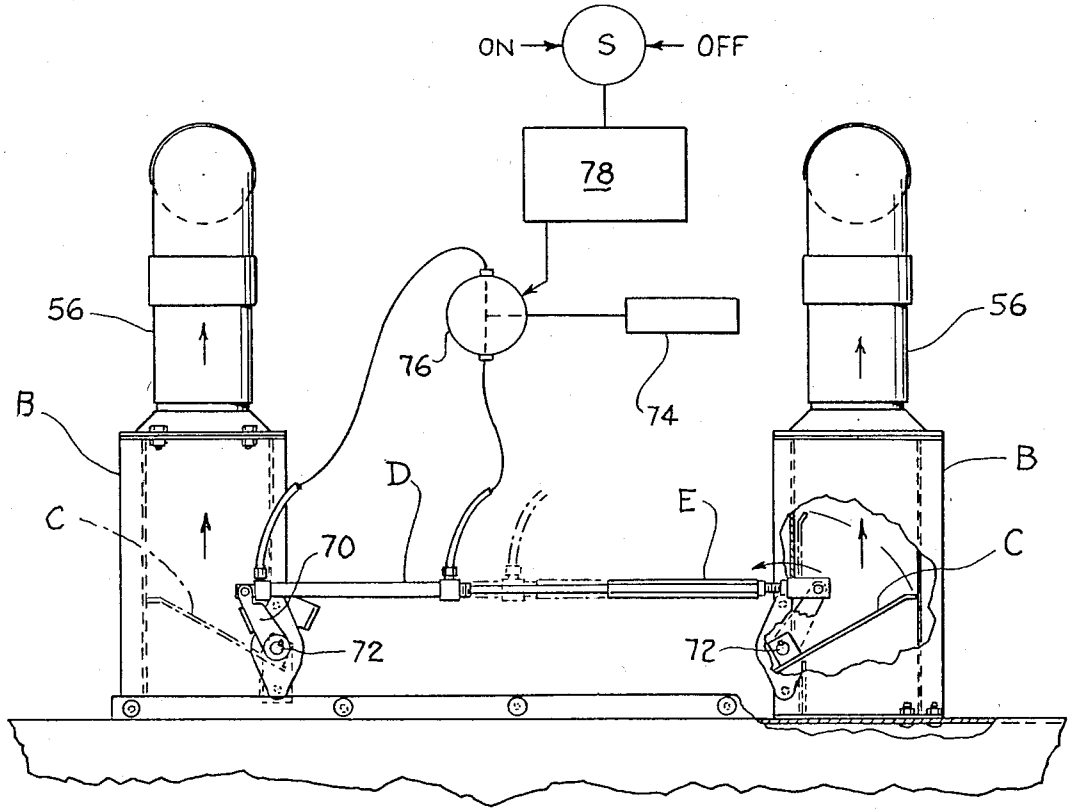
FIG. 2 is a front elevation of FIG. 1 illustrating the drawbox air shut-off apparatus and method in accordance with the invention.

Referring now in more detail to the invention, as can best be seen in FIGS. 1 and 2, a shut-off duct aassembly B is placed in each suction line 56. The shut-off assembly B is placed in the air suction line next to drawbox 24. There is a shut-off assembly B in each suction line 56 going to each coiler head in the drawbox cabinet. Each shut-off assembly B includes a bearing mounted flapper valve C. There is a pivot arm 70 connected on a pivot shaft 72 to which flapper valve C is affixed. A double acting air cylinder D and adjusting link E connect assemblies B together for simultaneous operation of valves C. Air for actuating air cylinder D in opposing directions is supplied from a compressed air source 74 by way of a conventional two-way solenoid valve 76. Solenoid 76 is controlled by a conventional timing circuit 78. Signal switch S supplies comber stop-start signals to control circuit 78.

Figure 3:
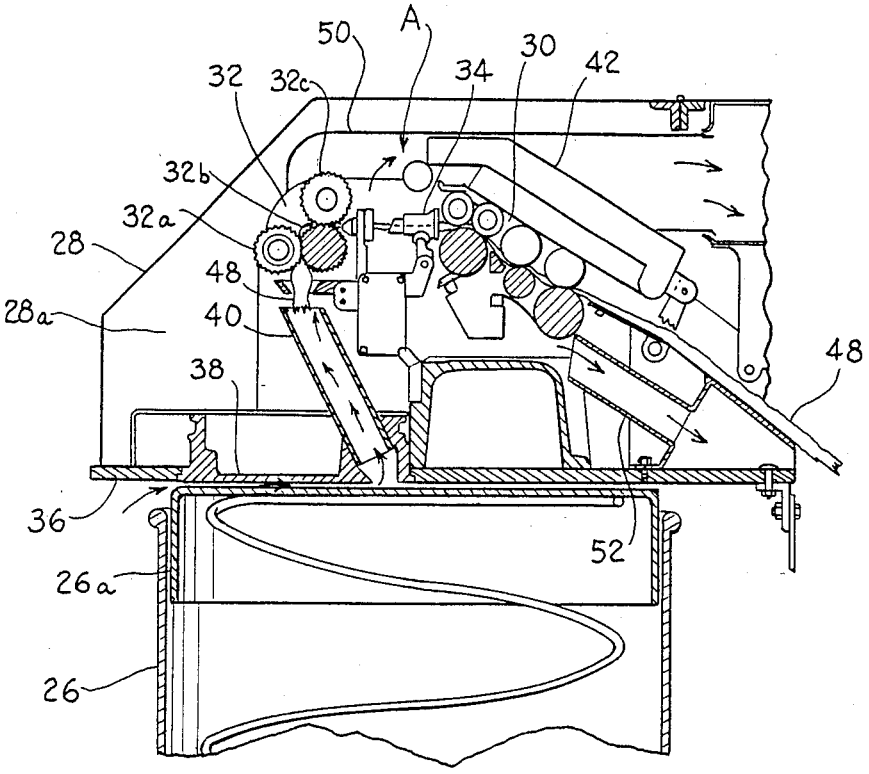
FIG. 3 is a sectional view taken through a coiling unit of a drawbox provided with an air suction shut-off apparatus in accordance with the present invention.
Figure 4:
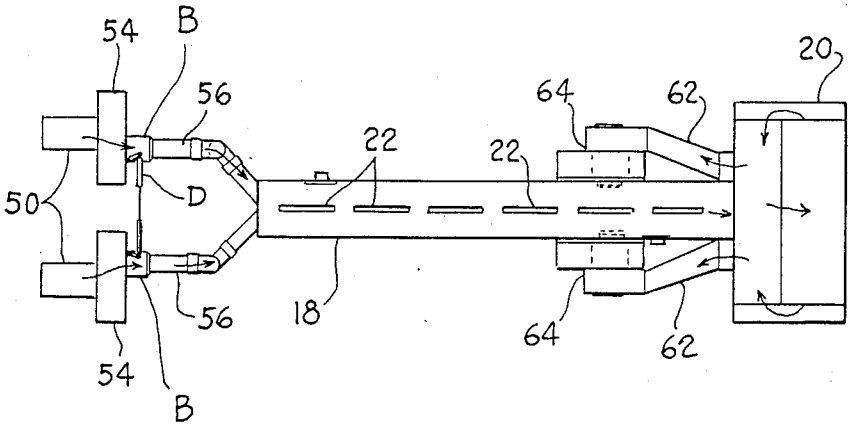
FIG. 4 is a top plan view of a vacuum cleaning system and drawbox suction air shut-off and method in accordance with the invention.

In operation of the comber, a pre-determined yardage of combed sliver is produced and deposited into delivery cans 26. After the cans are full, the comber is stopped and the doffing cycle begins. During the doffing cycle, the full cans are replaced by an empty can. As can be seen in FIG. 3, the spring loaded piston 26*a* of the empty can is forced upwardly towards coiler plate 36, but there is not an air seal. In operation with the conventional comber, air may seep between piston 26*a* and coiiler plate 36 into coiler tubes 40. When the comber is started, the vacuum draws excessive air through this seepage route. The sliver being delivered by the calender rollers cannot enter coiler tube 40 without interference from the air. Often, the sliver hits the lip of the coiler tube and is wound about the calender rolls or falls to the side of the coiler tube.

In accordance with the present invention, an improved method of operation occurs during the doffing cycle. When a prescribed yardage of sliver is deposited in the delivery cans, the comber stops. At this time, a signal from switch S to solenoid 76 applies control air to air cylinder D. Flapper valves C are closed to shut off suction air to the drawbox. Cover 28 is closed. Air pressure is equalized inside the coiler section of the drawbox during this period. After the cans are doffed, the comber is restarted and a signal from switch S sets timer circuit 78 to begin. Timer circuit 78 maintains flapper valve C closed and suction air shut-off in drawbox 24 for a period of time ater high speed operation is reached. This period of time is for about 30 to 120 seconds with 60 seconds being preferred. This period of time allows the sliver to properly feed into the coiler tubes 40 and into piston cans 26 without air interference. This time period may be adjusted as necessary so the proper amount of sliver can be run into th delivery cans to minimize stops. At the end of this period, control air is delivered to the opposing side of air cylinder D and the flapper valves are open. This allows the air suction to be restored to the drawbox for cleaning.

Thus it can be seen that an advantageous construction can be had for a suction air shut-off apparatus and method during the doffing cycle. The need and tendency to leave the drawbox top cover open during the doffing cycle is eliminated. Reliable silver feeding during start-up and at high speed operation to the delivery cans is provided.

While a preferred embodiment of the invention has been described using specific terms, such description is for illustrative purposes only, and it is to be understood that changes and variations may be made without departing from the spirit or scope of the following claims.

What is claimed is:

1. A method of controlling suction air to the drawbox of a textile comber during doffing of the type which includes a drafting element, a calender, a coiler having a coiler tube which deposits combed sliver into a delivery can below said coiler, a vacuum cleaning system which includes air suction nozzles disposed within said drawbox for cleaning said drafting element, calender, and coiler, said nozzles connected to suction line for removal of waste and air borne matter in the drawbox, said method controlling said suction air to facilitate entry of a new delivery of sliver into said coiler tube and coiler including:

placing a shut-off duct assembly in the suction line to said vacuum cleaning nozzles in said drawbox containing a valve for closing off said suction line to prevent air suction in said drawbox;

stopping said comber after coiling a prescribed amount of sliver in said delivery can;

doffing the full delivery can by replacement with an empty delivery can;

restarting said comber;

maintaining said valve in a closed position and said suction air shut-off during restart of said comber; and opening said valve to permit air suction in said drawbox after a prescribed amount of sliver has been properly introduced into said coiler tube and into the delivery can without air interference and said comber has reached a high-speed operation.

2. The method of claim 1 including maintianing said valve closed for a period of time in a range of about 30 to 120 seconds.

3. The method of claim 1 including maintaining said valve closed for a period of 60 seconds.

4. The method of claim 1 including closing said valve and air suction when said comber is stopped.

5. In a textile comber which includes a drawbox having a pair of coiler units each having a drafting element, a calender, a coiler with a coiler tube, and vacuum cleaning nozzles for removing waste and other air borne matter from said coiler units in said drawbox, suction lines connected to said vacuum cleaning nozzles for removal of said waste and air borne matter, combed sliver produced by said textile comber being fed by said coiling units to said coiler tube for deposit in delivery cans positioned below said coiler units, apparatus for shutting off the air suction in said drawbox during doffing of said delivery cans to facilitate reliable entry of said sliver into said coiler tube and coiler comprising:

shut off duct assemblies in said suction lines downstream of said vacuum cleaning nozzles;

a closure valve carried in said shut-off duct assemblies for shutting off the flow of suction air through said vacuum cleaning nozzles and said suction lines; and control means responsive to a prescribed quantity of sliver being deposited in said coiler can for moving said closure valves in a closed position for shutting off said air suction and maintaining said closure valves in said closed position for a prescribed period of time following doffing of said delivery cans during restart of said comber until sliver has been properly reintroduced into said coiler tube and cans.

6. The apparatus of claim 5 including actuating means mechanically connected to each shut-off duct assembly for simultaneous operation of said closure valves; and said control means being connected to said actuating means to simultaneously close and open said closure valves for coordinated control of suction air shut off.

7. The apparatus of claim 6 wherein said actuating means is an air cylinder having a piston rod; and adjustable linkage means connected to said piston rod for adjusting the mechanical linkage connection between said closure valve for proper and complete closure during actuation.

8. The apparatus of claim 7 wherein said air cylinder is a double actuated air cylinder ensuring positive positioning of said closure valve in both said open and closed positions by positive actuation of said actuating means.

9. A method of controlling the suction air to the drawbox of a textile comber during doffing, said comber being of a type which includes a coiling unit disposed within a drawbox enclosure which receives combed sliver and deposits said sliver in a delivery can below said coiling unit, and suction air is delivered to said drawbox enclosure for removing waste and other air borne matter from said drawbox enclosure adjacent said coiling unit, wherein said method includes controlling said suction air to facilitate entry of sliver into an empty leveling can which comprises:

stopping said comber when a prescribed amount of sliver has been deposited in said delivery can;

stopping the supply of suction air to said drawbox enclosure generally simultaneously with stopping said comber;

doffing said full delivery can by replacement with an empty delivery can;

restarting said comber;

maintaining said supply of suction air to said drawbox enclosure shut-off during restart of said comber; and resuming said supply of suction to said drawbox enclosure upon said comber reaching operational speed for a period of time in a manner that air interference with sliver delivery caused by excessive suction air is prevented during reentry of said sliver into said coil tube and delivery can.

10. The method of claim 9 including maintaining said supply of suction air shut-off after restarting of said comber for about 60 seconds after restart.

11. The method of claim 9 including maintaining said valve closed for a period of time in a range of about 30 to 120 seconds.

* * * * *